United States Patent [19]

Shearhart

[11] 4,411,314

[45] Oct. 25, 1983

[54] ATTACHMENT MEANS FOR USE FOR INSERTION AND RETRIEVAL OF A CASING PACKER

[75] Inventor: Billy G. Shearhart, Nowata, Okla.

[73] Assignee: Sooner Oil Tools, Inc., Nowata, Okla.

[21] Appl. No.: 287,366

[22] Filed: Jul. 27, 1981

[51] Int. Cl.[3] ..... E21B 23/00

[52] U.S. Cl. ..... 166/124; 166/139; 166/181; 285/24; 403/326; 279/79

[58] Field of Search ..... 166/123-125, 166/181, 182, 139, 381, 382; 403/326, 327, DIG. 7; 285/24, 27, 39, 321, 317, 318; 279/79, 80, 76, 29

[56] References Cited

U.S. PATENT DOCUMENTS

| | | | |
|---|---|---|---|
| Re. 28,641 | 12/1975 | Chenoweth | 166/139 |
| 52,947 | 2/1866 | Wilkinson | 166/139 |
| 1,185,116 | 3/1915 | Mack | 166/139 |
| 2,230,712 | 2/1941 | Bendeler et al. | 166/123 |
| 3,347,293 | 10/1967 | Clark | 403/326 |
| 3,643,737 | 2/1972 | Current et al. | 166/139 |

FOREIGN PATENT DOCUMENTS

| | | | |
|---|---|---|---|
| 1003233 | 9/1965 | United Kingdom | 166/124 |

*Primary Examiner*—James A. Leppink
*Assistant Examiner*—Hoang C. Dang
*Attorney, Agent, or Firm*—Head, Johnson & Stevenson

[57] ABSTRACT

Apparatus is provided for use with a packer positionable in a casing in which the packer has an upstanding male location member having a noncircular peripheral configuration having a circumferential slot adjacent the upper end, a female insertion member having means at the upper end for attachment to the lower end of a pipe string extending from the earth's surface and having a recess in the lower end slidably and nonrotatably receiving the upper end of the male location member and having an upper internal recess communicating with the tool open bottom, the recess having an internal enlarged diameter groove therein and a plurality of clips each configured as a segment of a washer positioned in the internal recess of the retrieval tool and having an elastomeric member therearound to inwardly bias the clips towards each other, the clips being expandable outwardly within the groove to receive the upper end of the location member and to enter into the external circumferential groove in the location member to thereby lock the location member to the retrieval tool.

3 Claims, 12 Drawing Figures

ATTACHMENT MEANS FOR USE FOR INSERTION AND RETRIEVAL OF A CASING PACKER

CROSS-REFERENCE TO RELATED APPLICATION

This invention is related to the application Ser. No. 287,367, filed cotemporaneously herewith which describes a packer which may be positioned in a well and retrieved from the well casing and in which the packer is set by rotation of an axial member in one direction and released from engagement from the casing by rotation in the opposite direction. The insertion and retrieval tools of this invention may be utilized with other types of packers, but the copending application is included herein by reference as an example of one of the means wherein the present invention is employed in installing and removing retrievable packers from an oil well casing.

BACKGROUND OF THE INVENTION

1. Field of the Invention

This invention relates to apparatus for positioning a packer in an oil or gas well casing, including a tool for actuating the packer to seal the interior of the casing, and a tool for entering back into the well for engaging the packer, releasing it from sealed engagement with the casing, and retrieving the packer from the casing.

2. Description of the Prior Art

The use of packers in oil and gas wells is well known, and numerous devices have been employed for positioning packers in wells and for retrieving them from wells. The present invention is distinguished over the prior art in its simplicity, economy, ease of operation and dependability.

SUMMARY OF THE INVENTION

The present invention is directed towards apparatus for use with a retrievable packer to enable the packer to be positioned and sealably secured within a casing and subsequently released from the casing and retrieved. The apparatus is for use with a packer of the type having a vertical axial member which is rotated in one direction to engage the packer with the interior of the casing and rotated in the opposite direction to release the packer. An upstanding male location member is secured to the upper end of the packer axial member. The location member has a noncircular peripheral configuration such as a square, hex, octagon, etc., and has a small diameter opening perpendicular the longitudinal axis adjacent the upper end. In addition, the location member has a circumferential groove in a plane perpendicular the longitudinal axis adjacent the upper end. For installing the packer an insertion tool is employed which is secured to the lower end of a string of tubing extending to the earth's surface. The insertion tool has a recess in the lower end which slidably and nonrotatably receives the upper end of the male location member and has a small diameter opening therein perpendicular the vertical axis which corresponds to the similar small diameter opening in the location member. A severable pin is inserted in the aligned opening in the insertion member and the location member so that these are secured together. In this manner a packer may be suspended by the insertion tool so that the packer may be lowered into a pre-selected position in the casing of an oil or gas well. When the desired position is reached, the tubing is rotated in the proper direction to cause the packer to seal against the interior of the casing. After the packer is fully sealed against the interior of the casing, the tubing string can be removed by exerting an upward pull at the earth's surface. This upward pull severs the pin inserted in the small diameter openings allowing the insertion tool to separate from the male location member. The tubing or rods may then be removed from the well leaving the packer in the well. To remove the packer a retrieval tool is employed which is affixed at the lower end of the tubing in place of the insertion tool. The lower end of the retrieval tool is bell-shaped and has a recess which is relatively large at the lower end and tapers upwardly and inwardly to a recess conforming to the noncircular configuration of the male location member. The retrieval tool has an internal circumferential groove therein which is in a plane perpendicular the vertical axis of the tool and which is in register with the circumferential groove in the retrieval tool when the retrieval tool is in position engaging the location member. Positioned in the groove in the retrieval tool are a plurality (three or four being a good number) of C-shaped clips having an elastomeric band around the exterior periphery. The clips when in their innermost position are in the shape of segments of a washer. The clips slide radially inwardly and outwardly within the groove in the retrieval tool. When the retrieval tool is lowered into position to engage the upstanding male location member, the clips radially expand outwardly in the groove and enter into the external circumferential groove in the location member. The clips then extend partially within the groove in the location member and partially in the groove in the retrieval tool. The tubing can then be rotated in the direction to release the sealed engagement of the packer from the casing and the packer then lifted out of the casing by the tubing.

DESCRIPTION OF THE PREFERRED EMBODIMENTS

Figure 4:
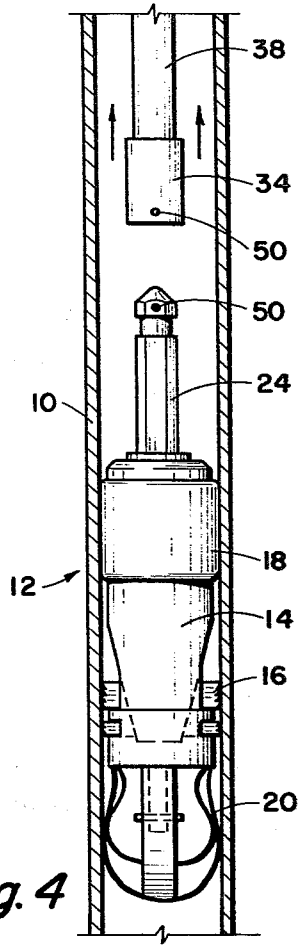
FIG. 4 is an elevational view as in FIGS. 1, 2 and 3 showing the final step of positioning and setting the packer wherein the tubing has been pulled upwardly, severing the pin connecting the packer with the insertion tool.

Referring to the drawings and first to FIGS. 1 through 5, the invention will be described as employed for installing a retrievable packer in a casing. An oil well casing is indicated by the numeral 10 and is customarily positioned in a drill borehole in the process of drilling and completing an oil or gas well. The casing functions to prevent the borehole from collapsing and to provide means of controlling fluid flow in the borehole. The casing may be cemented in position in the borehole by injecting cement into the annular area exterior of the casing so as to seal off one formation from another. In order to seal the interior of the casing into separate zones, packers are employed. This invention is directed toward a means of installing and retrieving a packer from the interior of casing 10.

A packer is generally indicated by the numeral 12. The specific configuration and arrangement of packer 12 is not a part of this invention and for details of a packer to which the invention is applicable reference may be had to the copending application filed contemporaneously herewith which is above-referenced. In general, a packer of the type to which this invention is useful includes a body 14 having slips 16 which engage the interior of the casing 10 to hold the packer in a preselected position. A packing gland 18 of elastomeric material provides a means of sealing the interior of the casing. Drag springs 20 resiliently extend from the packer body to engage the interior wall of casing 10 so that the packer may be freely moved up and down within the casing but resists rotation of the lower element so as to enable the packer to be set and unset. The packer 10 is of the type including a vertical axial shaft having an upper threaded end 22 (see FIG. 5) by which the packer is supported. The packer is set or unset by the rotation of the shaft.

Extending from the packer shaft 22 is a vertical location member 24. A threaded recess 26 in the lower end of the location member receives the packer shaft 22. The upper end portion 28A of location member 24 is of noncircular external configuration, such as square, hexagonal, octagonal, the hexagonal configuration being considered optimum, as illustrated. The upper end is pointed at 30 and is conical, tapering down to the hexagonal circumferential area around end portion 28. A small diameter opening 32 which is perpendicular to the longitudinal axis of the location member is formed in the upper portion 28. Spaced below the upper portion but at the upper end of the member 24 is a circumferential groove 33 which has a reduced external diameter, the plane of the groove being perpendicular the longitudinal axis of the member 24.

To position packer 12 in casing 10 and to secure it in sealed relationship to the casing, an insertion tool is employed. This tool is attached to the lower end of a string of tubing 38 extending to the earth's surface. Packer 12 is lowered by the addition of lengths of tubing until the proper depth is reached. The insertion tool 34 has a threaded recess 40 (see FIG. 5) in the upper end which receives the lower threaded end 42 of tubing 38. To prevent the insertion tool 34 from becoming unthreaded from the tubing threaded end 42, a pin 44 may be inserted through openings in these two members; however, in practice the direction of rotation of the insertion tool 34 is that which tightens threads 42, and therefore, there does not arise the likelihood of the insertion tool becoming unthreaded.

The lower end of the tool 34 includes a recess 46 which is noncircular and is configured to slidably and nonrotatably receive the external configuration of the location member upper end portion 28. The insertion tool 34 has a small diameter opening 48 (see FIG. 1) which is perpendicular to the longitudinal axis of the member and which is in register with opening 32 in the location member when the parts are assembled at the earth's surface preparatory to lowering the packer into the casing. Into the aligned openings 32 and 48 a pin 50 is placed which supports the packer as it is positioned in the casing.

Figure 3:
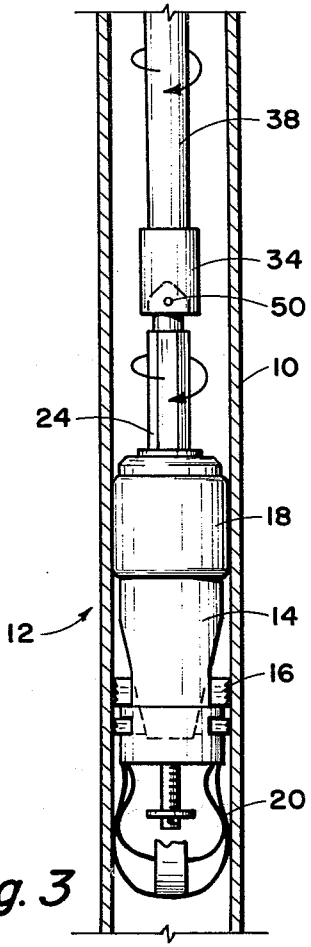
FIG. 3 is an elevational view as in FIGS. 1 and 2 with the tubing further rotated to expand the elastomeric portion of the packer and to seal engagement with the interior of the tubing so that the packer is completely set in the casing.
Figure 2:
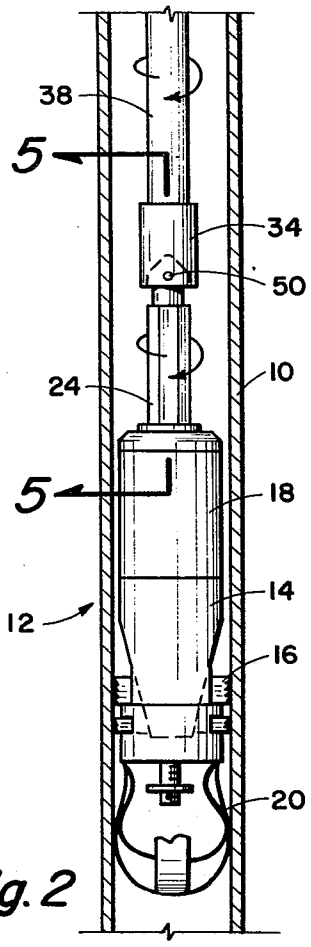
FIG. 2 is a view as in FIG. 1 showing the packer in the selected position in the casing and the tubing by which it is suspended being rotated to force the slips of the packer into engagement with the interior of the casing.
Figure 1:
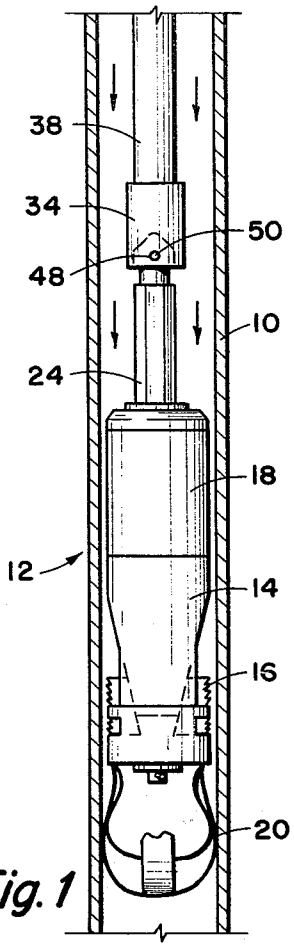
FIG. 1 is an elevational view of a packer which has been lowered into position in a casing, the casing being shown in cross-section and the other elements in external elevational view and showing the packer supported by a length of tubing and an insertion tool.
Figure 5:
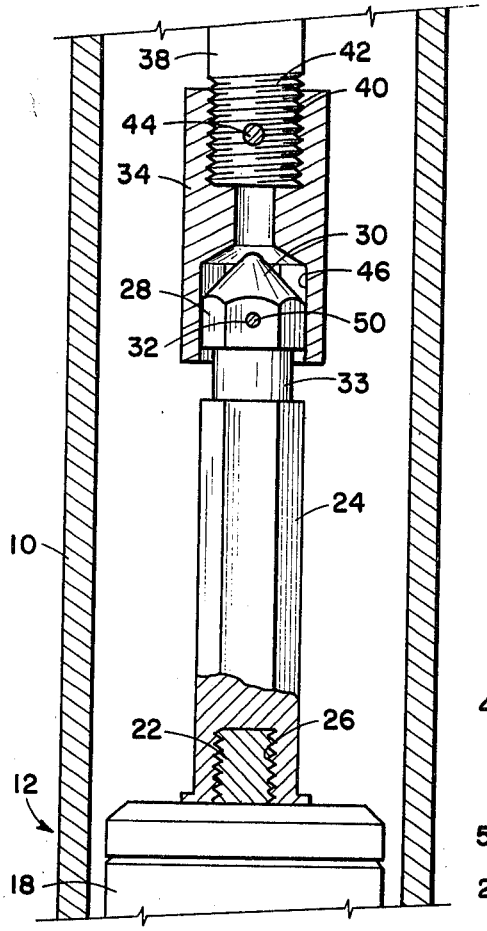
FIG. 5 is a cross-sectional view taken along the line 5—5 of FIG. 2 and showing the internal arrangement of the insertion tool and the external arrangement of the location tool affixed to the packer. The lower end of the location tool is shown in cross-section to show one means by which it is secured to a packer.
Figure 12:
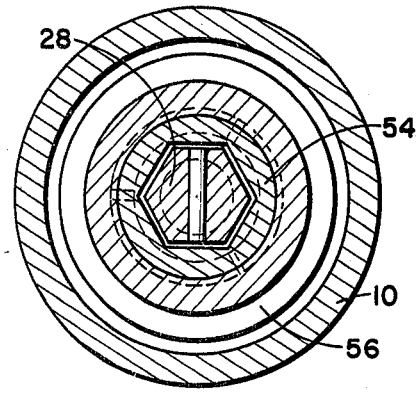
FIG. 12 is a cross-sectional view taken along the line 12—12 of FIG. 10 as the retrieval tool is fully inserted into the location member.

To set the packer the sequences illustrated in FIGS. 1 through 4 are employed. FIG. 1 shows the packer positioned in casing 10 at the desired location. Tubing 38 is rotated as indicated by the arrow in FIG. 2. This actuates the packer to first set the slips 16, that is, radially extends the slips 16 to engage the interior wall of the casing 10 to securely lock the packer in place. Further rotation in the same direction as indicated in FIG. 3 causes the packing gland 18 to expand outwardly to seal the interior of the casing. In the position as shown in FIG. 3, the packer has been locked in position and sealed so as to close off the portion of the casing below the packer from that above the packer. To remove the tubing 38, it is merely pulled directly upward as shown by the arrows in FIG. 4, severing the pin 50, and separating the insertion tool 34 from the location member 24. Tubing 38 can then be removed and the packer is left in the casing for as long as necessary to serve to separate the interior of the casing into separate zones.

Figure 10:
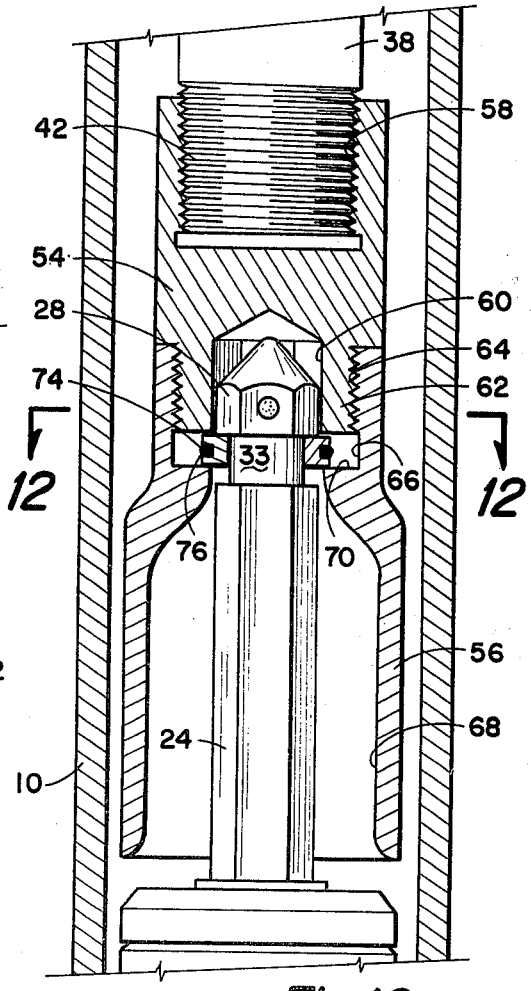
FIG. 10 is a cross-sectional view as in FIG. 9 showing the retrieval tool fully positioned on the location member. The retrieval tool may be rotated to disengage the packer from the casing and subsequently the packer removed from the casing by pulling the tubing.
Figure 8:
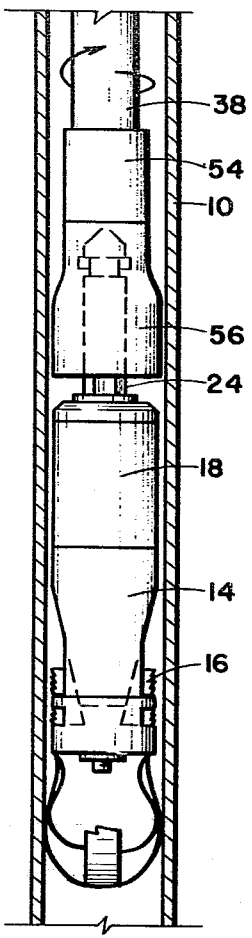
FIG. 8 is a view as in FIG. 7 showing continued rotation of the tubing so that the slips of the packer have been retracted and the packer is completely released from engagement with the interior of the casing and may be withdrawn by pulling the tubing from the well.
Figure 9:
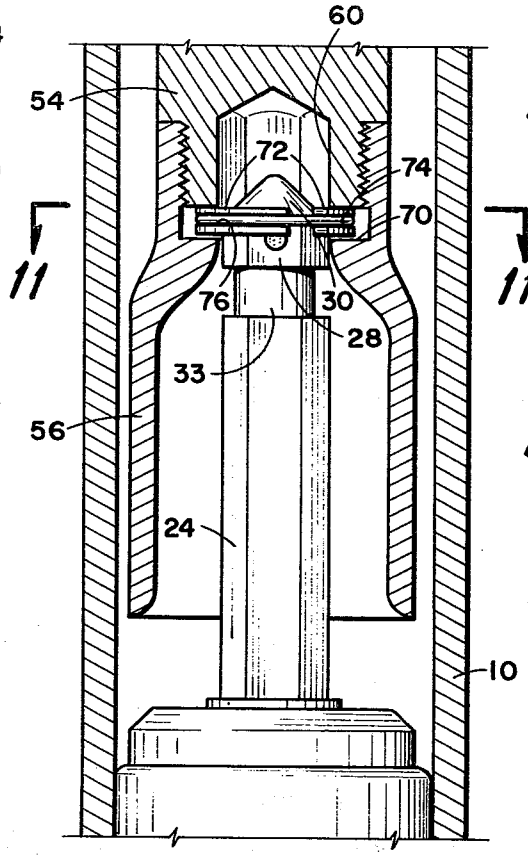
FIG. 9 is an enlarged cross-sectional view of the retrieval tool shown in the position as the retrieval tool is inserted onto the location member.
Figure 6:
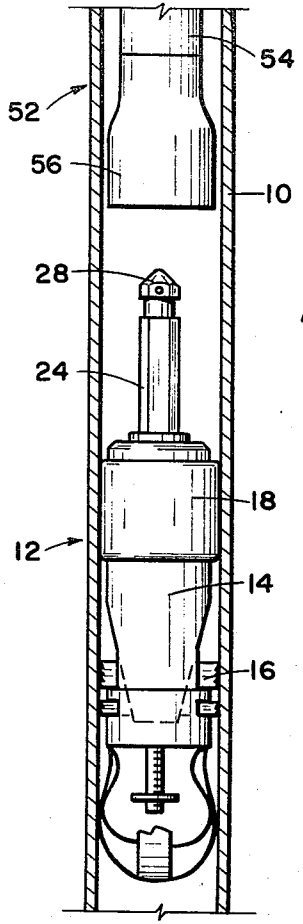
FIG. 6 is an elevational view showing the packer positioned in a casing and showing a retrieval tool as it is lowered into position to engage and retrieve the packer.

To understand the steps of retrieving the packer from casing 10, reference should now be had to FIGS. 6 through 12. FIG. 6 shows the packer 12 in position in the hole as left there by the steps of FIGS. 1 through 4. To retrieve the packer a retrieval tool 52 is attached at the lower end of tubing 38. FIG. 6 shows the retrieval tool 52 directly above the packer. The internal arrangement of the retrieval tool is shown in FIGS. 9 and 10.

The retrieval tool includes an upper body portion 54 and a lower bell portion 56. The upper body portion 54 has a threaded recess 58 therein which receives the lower threaded end 42 of tubing 38. The body portion 54 is further defined by a lower internal recess 60 which is of noncircular configuration to slidably and nonrotatably receive the location member upper end portion 28. The lower end of the body portion 54 has a reduced external diameter threaded section 62 which receives the internal threaded upper end 64 of the bell portion 56. Formed in the bell portion 56 below the upper end is an internal circumferential groove 66 in a plane perpendicular the member vertical longitudinal axis. The lower end of the bell portion 56 has an enlarged internal diameter recess 68. The recess tapers up to notch 66, the notch providing a circumferential shoulder 70.

Figure 11:
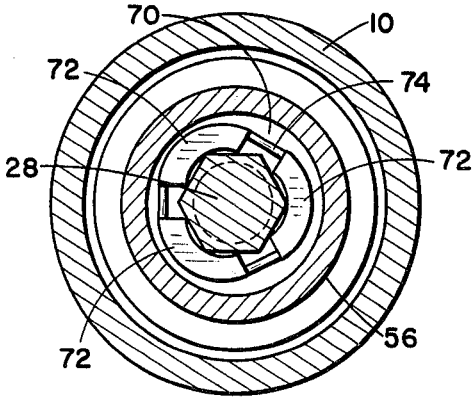
FIG. 11 is a cross-sectional view taken along the line 11—11 of FIG. 9 showing the relationship of the clip elements as the retrieval tool is inserted onto the location member.

Received in notch 68 is a plurality of C-shaped clips 72 (see FIGS. 9, 10, and 11 for best illustration). While two or more of the C-shaped clips may be utilized, the preferred number is three, as illustrated, although four or more may also be employed. The C-shaped clips 72 form, when contiguous to each other, a washer-shaped device having an external diameter larger than the smallest diameter of groove 66 so that the clip members are retained within the groove. The clip members are biased towards each other by means of an elastic band 74; and to retain the band in place, the clip members have on their external peripheral surface a groove 76. The height of the retrieval tool groove 66 is greater than the thickness of the C-shaped clips 72 so they are free to expand radially inwardly and outwardly, that is, towards each other or away from each other but are biased towards each other by the elastic band 74.

Referring to FIG. 9, as the retrieval tool is lowered into position, the bell portion 56 passes over the upper end 28 of the location member 24 so that the upper conical pointed end portion 30 extends beyond shoulder 70 and into recess 60. As the pointed end 30 engages the C-shaped clips, they are forced outwardly away from each other allowing the location member upper end portion 28 to pass into the recess 60. As the upper end portion 28 passes the C-shaped members, they enter into the external groove 33 in the location members and assume the position as shown in FIG. 10 in which the C-shaped members are partially within the groove 66 in the retrieval tool and partially in external groove 33 in the location member. Thus, the retrieval tool is locked to the location member, both rotatably and longitudinally.

Figure 7:
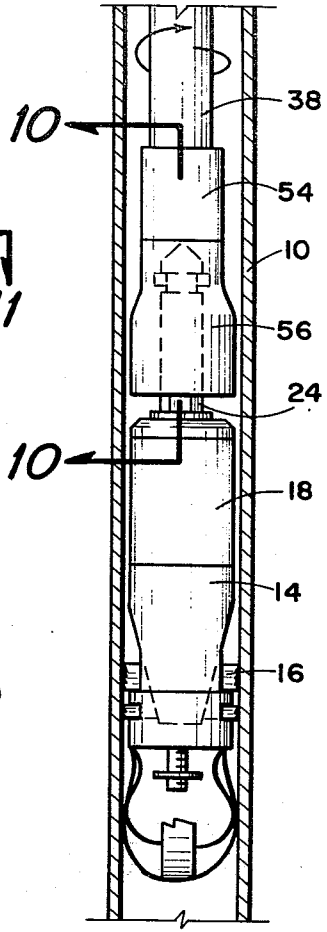
FIG. 7 shows the next step in the retrieval of the packer wherein the retrieval tool has been inserted into engagement with the location member and the tubing rotated in the opposite direction so that the elastomeric portion of the packer is allowed to retract from engagement with the interior of the casing.

To retrieve the packer the tubing 38 is rotated in the direction opposite that required to set the packer as shown in FIGS. 7 and 8. FIG. 7 shows the tubing 38 having been rotated to rotate the location member and thereby the member shaft portion so that the packing gland 18 has been decompressed to remove its sealed engagement with the interior of the casing 10. FIG. 8 shows the tubing 38 having been rotated further to disengage slips 16. FIG. 8 illustrates the packer having been completely disengaged from the interior of the casing and ready to be withdrawn from the casing by upward retrieval of the tubing 38.

After the packer has been removed from the interior of the tubing, it may be separated from the retrieval tool by unthreading the upper portion 54 from the bell portion 56 to permit the C-shaped clips 72 to be spread apart such as by the use of a screwdriver so that they can be extracted from the location member 24.

The invention provides a unique and substantially foolproof method of positioning a packer in a casing, sealably actuating the packer to close the interior of the casing, and leaving it in position after the tubing by which it is to be inserted is removed. Subsequently, when it is desired to retrieve the packer the invention provides a retrieval tool which is capable of engaging the packer to allow it to be unseated from the casing and retrieved by removal of the tubing. All is accomplished with inexpensive apparatus and yet in a manner such as to greatly reduce the chance of a mishap which would leave a packer in a casing without means of retrieval.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. For use with a retrievable packer positionable in a casing in which the packer has a vertical axial member extending upwardly therefrom, the packer being set by the rotation of the axial member in one direction and released from sealed relationship with the casing by rotation in the other direction, a retrieval tool for use on the lower end of a tubing string for releasing and retrieving the packer comprising:

an upstanding male location member having a noncircular peripheral configuration and having spaced from the upper end thereof an external circumferential groove of selected height, the lower end being affixable to the upper end of a packer axial member;

a retrieval tool of external diameter less than the interior diameter of the casing in which it is used and having means at the upper end for attachment to the lower end of a string of tubing extending from the earth's surface, the retrieval tool having an upper internal recess communicating with the tool open bottom, the recess being configured to slidably and non-rotatably receive the upper end of said male location member, the recess being defined in part by an internal, enlarged diameter groove of selected height so that when the upper end of said male location member is received in the recess in the retrieval tool, the grooves are in register; and a plurality of clips each configured as the segment of a washer having thickness less than the height of said grooves in said location member and said retrieval tool, the clips being positioned in said internal recess in said retrieval tool and expandably outwardly in the groove to permit the upper end portion of said location member to pass and, when said groove on said location member is in register, to enter into the groove thereon whereby each clip extends partially within both said grooves to axially lock said retrieval tool to said location member; and means to resiliently inwardly bias said clips.

2. A retrieval tool according to claim 1 wherein said means to resiliently inwardly bias said clips includes elastomeric means encompassing the clips.

3. A retrieval tool according to claim 2 wherein each said clip has a groove in the external, peripheral edge thereof and wherein said elastomeric means is in the form of a band received in the peripheral grooves of said clips.

* * * * *